US011193350B2

(12) United States Patent
Kuo et al.

(10) Patent No.: US 11,193,350 B2
(45) Date of Patent: Dec. 7, 2021

(54) WELL TOOL HAVING A REMOVABLE COLLAR FOR ALLOWING PRODUCTION FLUID FLOW

(71) Applicant: Halliburton Energy Services, Inc., Houston, TX (US)

(72) Inventors: Nicholas Kuo, Dallas, TX (US); Matthew Brian Roseman, Lancaster, TX (US); Luke Holderman, Plano, TX (US); Frank Giusti, Jr., Pilot Point, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 739 days.

(21) Appl. No.: 16/066,237

(22) PCT Filed: Nov. 17, 2017

(86) PCT No.: PCT/US2017/062176

§ 371 (c)(1),
(2) Date: Jun. 26, 2018

(87) PCT Pub. No.: WO2018/118291

PCT Pub. Date: Jun. 28, 2018

(65) Prior Publication Data

US 2021/0164323 A1 Jun. 3, 2021

Related U.S. Application Data

(60) Provisional application No. 62/438,670, filed on Dec. 23, 2016.

(51) Int. Cl.
*E21B 34/06* (2006.01)
*E21B 29/00* (2006.01)
(Continued)

(52) U.S. Cl.
CPC ..... *E21B 34/063* (2013.01); *E21B 29/002* (2013.01); *E21B 43/12* (2013.01); *E21B 43/26* (2013.01); *E21B 2200/08* (2020.05)

(58) Field of Classification Search
CPC ..... E21B 34/063; E21B 29/002; E21B 43/26; E21B 43/12; E21B 2200/08
See application file for complete search history.

(56) References Cited

U.S. PATENT DOCUMENTS 6,237,688 B1 5/2001 Burleson et al.
8,020,620 B2 9/2011 Daniels et al.
(Continued)

FOREIGN PATENT DOCUMENTS

WO 2012174662 12/2012
WO 2015039697 3/2015
WO 2017041105 3/2017

OTHER PUBLICATIONS

Canadian Application No. CA3,043,742 , "Office Action", dated Apr. 28, 2020, 3 pages.
Denmark Application No. DKPA201970323 , "Office Action", dated Mar. 5, 2020.
French Application No. FR1760924 , "Search Report", dated Mar. 17, 2020, 9 pages.
(Continued)

*Primary Examiner* — James G Sayre
(74) *Attorney, Agent, or Firm* — Kilpatrick Townsend & Stockton LLP

(57) ABSTRACT

A device can include a collar positioned in a wellbore that can include an outer wall. The outer wall can define an inner area of the collar and can prevent fluid flow between the inner area of the collar and an outer area of the collar during a hydraulic fracturing process. The collar can be removed or dissolved to form a flow path to allow production fluid to flow between the inner area of the collar and the outer area of the collar subsequent to the hydraulic fracturing process.

16 Claims, 7 Drawing Sheets

(51) Int. Cl.
*E21B 43/12* (2006.01)
*E21B 43/26* (2006.01)

(56) References Cited

U.S. PATENT DOCUMENTS

| | | | | |
|---|---|---|---|---|
| 8,424,610 | B2 * | 4/2013 | Newton | E21B 34/063 166/376 |
| 2007/0039741 | A1 | 2/2007 | Hailey, Jr. | |
| 2007/0221384 | A1 | 9/2007 | Murray | |
| 2009/0000786 | A1 | 1/2009 | Daniels et al. | |
| 2011/0100643 | A1 * | 5/2011 | Themig | E21B 34/102 166/373 |
| 2013/0168099 | A1 | 7/2013 | Themig | |
| 2014/0034310 | A1 | 2/2014 | Andersen | |
| 2014/0166111 | A1 | 6/2014 | Wilkin | |
| 2015/0226041 | A1 | 8/2015 | Holderman et al. | |
| 2015/0337623 | A1 * | 11/2015 | Carrejo | E21B 34/063 166/373 |
| 2017/0096876 | A1 | 4/2017 | Flores Perez et al. | |
| 2018/0038199 | A1 * | 2/2018 | Madell | E21B 43/08 |

OTHER PUBLICATIONS

Halliburton RapidShift Sleeve System Product Sheet, available at http://www.halliburton.com/en-US/ps/completions/well-completions/horizontal-completions/rapidshift.page, Oct. 2016, 2 pages.

Halliburton EquiFlow Sliding Side-Door Inflow Control Device Product Sheet, available at http://www.halliburton.com/en-US/ps/completions/sand-control/screens/special-screens/petroguard-reg-sliding-side-door-reg-screen.page, Aug. 2011, 2 pages.

International Patent Application No. PCT/US2017/062176, "PCT Search Report and Written Opinion", dated Feb. 14, 2018, 19 pages.

Application No. ARP170103242 , Office Action, dated Sep. 27, 2020, 5 pages.

Application No. DKPA201970323 , Office Action, dated Apr. 6, 2021, 2 pages.

Application No. DKPA202170143 , Office Action, dated May 12, 2021, 7 pages.

GB1906508.5 , "First Examination Report", dated Apr. 6, 2021, 4 pages.

Application No. SG11201904034U , Written Opinion, dated Oct. 26, 2020, 12 pages.

* cited by examiner

WELL TOOL HAVING A REMOVABLE COLLAR FOR ALLOWING PRODUCTION FLUID FLOW

CROSS REFERENCE TO RELATED APPLICATION

This disclosure claims the benefit of priority of U.S. Provisional Application No. 62/438,670, titled "Well Tool having a Millable Collar for Allowing Production Fluid Communication" and filed on Dec. 23, 2016, which is hereby incorporated in its entirety by this reference.

TECHNICAL FIELD

The present disclosure relates generally to tools usable in extracting hydrocarbons from a subterranean formation. More specifically, but not by way of limitation, this disclosure relates to a well tool having a removable collar for allowing production fluid flow.

BACKGROUND

A well system, such as an oil or gas well for extracting hydrocarbon fluids from a subterranean formation, can perform hydraulic fracturing to increase the flow of the hydrocarbon fluids from the subterranean formation. Hydraulic fracturing can include pumping a treatment fluid including a proppant mixture into a wellbore formed through the subterranean formation. The treatment fluid can create fractures in the subterranean formation and the proppant mixture can fill the fractures to prop the fractures open. Propping the fractures open can allow the hydrocarbon fluids to flow from the subterranean formation through the fractures and into the wellbore more quickly than through the matrix of the undisturbed formation.

Well tools can perform various functions in a wellbore, including forming a flow path for fluids traversing the wellbore. In some examples, a tool can include ports for allowing treatment fluid to flow from an inner area of the tool toward the subterranean formation for forming the fractures. In additional or alternative examples, a tool can include ports for allowing production fluid (e.g., oil or gas) to flow from the subterranean formation into an inner area of the tool and toward the surface through the wellbore.

DETAILED DESCRIPTION

Figure 1:
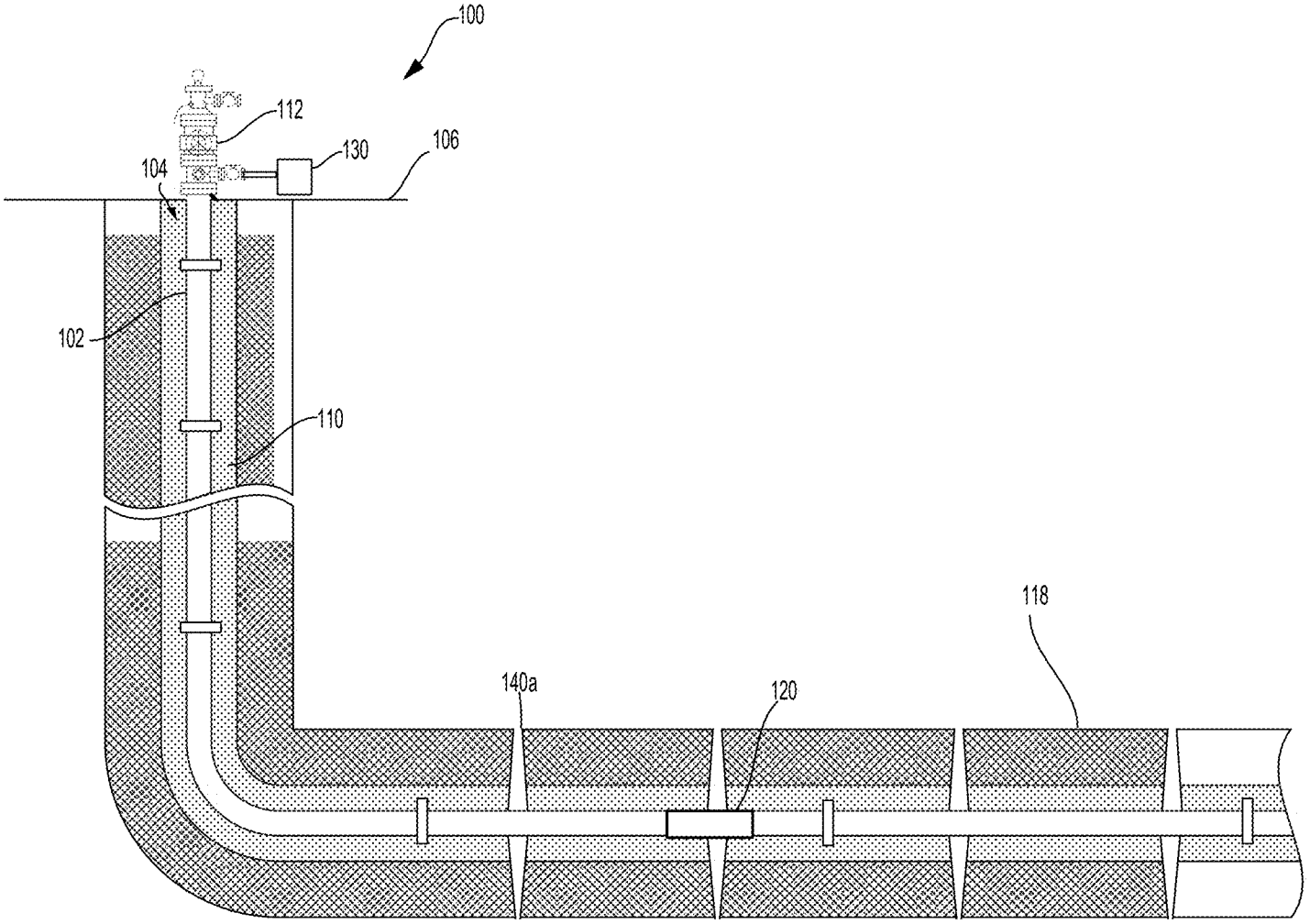
FIG. 1 is a diagram of an example of a well system including a well tool having a removable collar for allowing production fluid flow according to one aspect of the present disclosure.

Certain aspects and features of the present disclosure relate to a well tool having a removable or partially removable collar for allowing production fluid flow. In some aspects, the well tool can be positioned in a wellbore and include a tubular body and a collar. The tubular body can include an outer wall for defining an inner area through which fluid (e.g., treatment fluid or production fluid, which can include liquids or gasses) can longitudinally traverse the tubular body. The tubular body can have an opening through the outer wall and the collar can be positioned in the inner area of the tubular body for sealing the opening to prevent fluid from flowing radially through the opening between the inner area and an outer area. In some examples, the collar can be an annulus such that a flow path remains longitudinally through the inner area of the tubular body. Radial fluid communication for fluid flow between the inner area and the outer area via the opening can be allowed by wholly or partially removing the collar. The opening can be a port for forming part of a radial fluid flow path between an inner area and an outer area of the tubular body by wholly or partially removing the collar.

In additional or alternative aspects, the collar may form a joint between an upper tubular body and a lower tubular body, or the collar may be a standalone component. The collar can have an outer wall that defines the inner area and the outer area. The collar can be partially removed to create an opening and flow path between the inner area and outer area to allow production fluid flow.

In some aspects, the well tool can be present in a wellbore during a hydraulic fracturing process and the collar can prevent treatment fluid or fracturing fluid from flowing through the opening. In some examples, the collar can be removed during a millout run after the hydraulic fracturing process such that production fluid can follow a flow path through the port from a subterranean formation to the surface of the wellbore. In additional or alternative examples, the collar can dissolve after the hydraulic fracturing process such that production fluid can follow a flow path through the port from the subterranean formation to the surface of the wellbore. In additional or alternative aspects, the well tool can include another opening that is unblocked by the collar and that forms a path for treatment fluid to flow from an inner area of the tubular body to an outer area of the tubular body to form fractures in the subterranean formation.

In some examples, a well tool with a removable collar can include few to no moving parts as compared to a mechanical shifting tool, which can be positioned in a tubular body for closing one or more fracture fluid ports and opening one or more production fluid ports. The fracture fluid ports allow treatment fluid to flow from the surface of a wellbore to a portion of the subterranean formation and the production fluid ports allow treatment fluid to flow from the subterranean formation to the surface of the wellbore. The mechanical shifting tool includes moving components that shift to close one or the other of the fracture fluid ports and production fluid ports. The shifting process can take time to perform. A well tool having a removable collar (e.g., a collar that can be removed by drilling along the longitudinal axis of the tubular body) can be more robust and less expensive than a mechanical shifting tool. In some examples, the well tool may not include any moving components. The collar sealing the production fluid ports can be removed as part of the end of a hydraulic fracturing process. In some examples, the collar can be removed during a millout run, which can be performed to remove obstructions after a hydraulic fracturing process. In additional or alternative examples, the collar can dissolve in response to contact with fluid present in the wellbore at the end or subsequent to the hydraulic fracturing process. The well tool can provide production fluid ports that do not add any additional operation to the completion. The removal of the collar and absence of moving parts can allow the cross-sectional area of the well tool to be more effectively used and can result in higher than normal pressure ratings.

These illustrative examples are given to introduce the reader to the general subject matter discussed here and are not intended to limit the scope of the disclosed concepts. The following sections describe various additional features and examples with reference to the drawings but, like the illustrative aspects, should not be used to limit the present disclosure.

FIG. 1 illustrates an example of a well system 100 that include a well tool 120 with a collar that can be removed to allow production fluid flow. The well system 100 includes a completion string 102 positioned in a wellbore 104 that has been formed in a surface 106 of the earth and through the subterranean formation 118. The well system 100 may have been constructed and completed in any suitable manner, such as by use of a drilling assembly having a drill bit for creating the wellbore 104. The completion string 102 may include tubular casing sections connected by end-to-end couplings. In some aspects, the completion string 102 may be made of a suitable material such as steel. Within the wellbore 104, cement 110 may be injected and allowed to set between an outer surface of the completion string 102 and an inner surface of the wellbore 104.

At the surface 106 of the wellbore 104, a tree assembly 112 may be joined to the completion string 102. The tree assembly 112 may include an assembly of valves, spools, fittings, etc. to direct and control the flow of fluid (e.g., oil, gas, water, etc.) into or out of the wellbore 104 within the completion string 102. For example, a pump 130 (e.g., well stimulation pumping equipment) can be coupled to the tree assembly 112 for injecting a treatment fluid into the wellbore 104 as part of a hydraulic fracturing process. The treatment fluid can form fractures 140 through holes, sleeves, or ports in the completion string 102, through the cement 110 or open annulus, and into the surrounding subterranean formation 118. In some aspects, the treatment fluid includes proppant that can be positioned in the fractures 140 to prop the fractures 140 open such that production fluid can flow from the surrounding subterranean formation 118 into the wellbore 104.

The well tool 120 can include a tubular body and form part of the completion string 102. The well tool 120 can include an opening in an outer wall or side of the tubular body that is sealed by a collar positioned in an inner area of the tubular body. The collar can prevent radial fluid flow between the inner area of the tubular body and an outer area (e.g., the subterranean formation 118). The collar can be removed subsequent to an event in the wellbore 104 (e.g., completion of a hydraulic fracturing operation) such that a radial flow path forms through the opening from between the inner area and the outer area.

Figure 2:
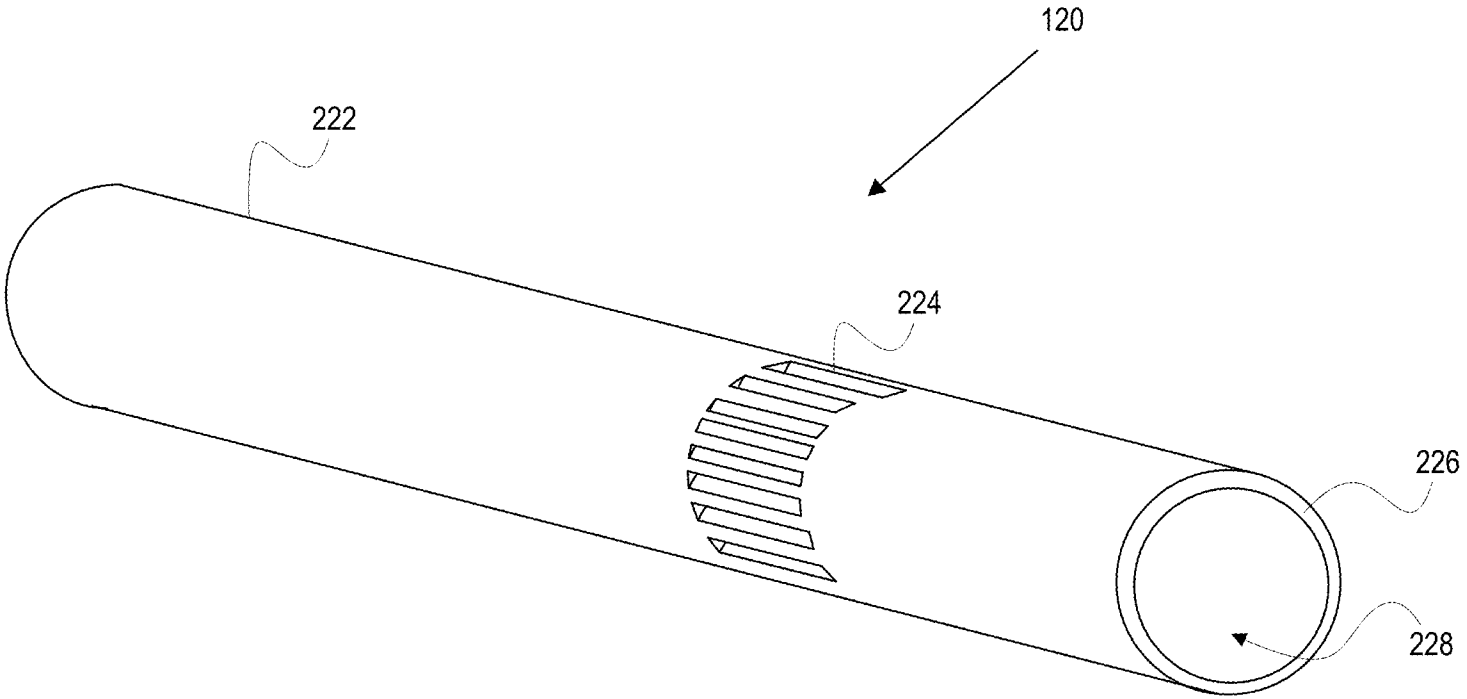
FIG. 2 is a perspective view of an example of a well tool having a removable collar for allowing production fluid flow according to one aspect of the present disclosure.

FIG. 2 is a perspective view of the well tool 120 in FIG. 1. The well tool 120 can include a tubular body 222 with one or more openings 224 in an outer wall 226 that defines an inner area 228 of the tubular body 222. The well tool 120 can further include a collar (not depicted) that can be positioned in the inner area 228 for preventing a flow path between the inner area 228 and an outer area (e.g., the subterranean formation 118 in FIG. 1) through the openings 224. The collar can be a ring-shaped component that is removable. In some examples, the collar can be minable (e.g., drillable) such that the collar can be wholly or partially removed using a milling tool. In additional or alternative examples, the collar, or plugs in the ports of the collar, can be dissolved in response to contact with a dissolving fluid.

Figure 3:
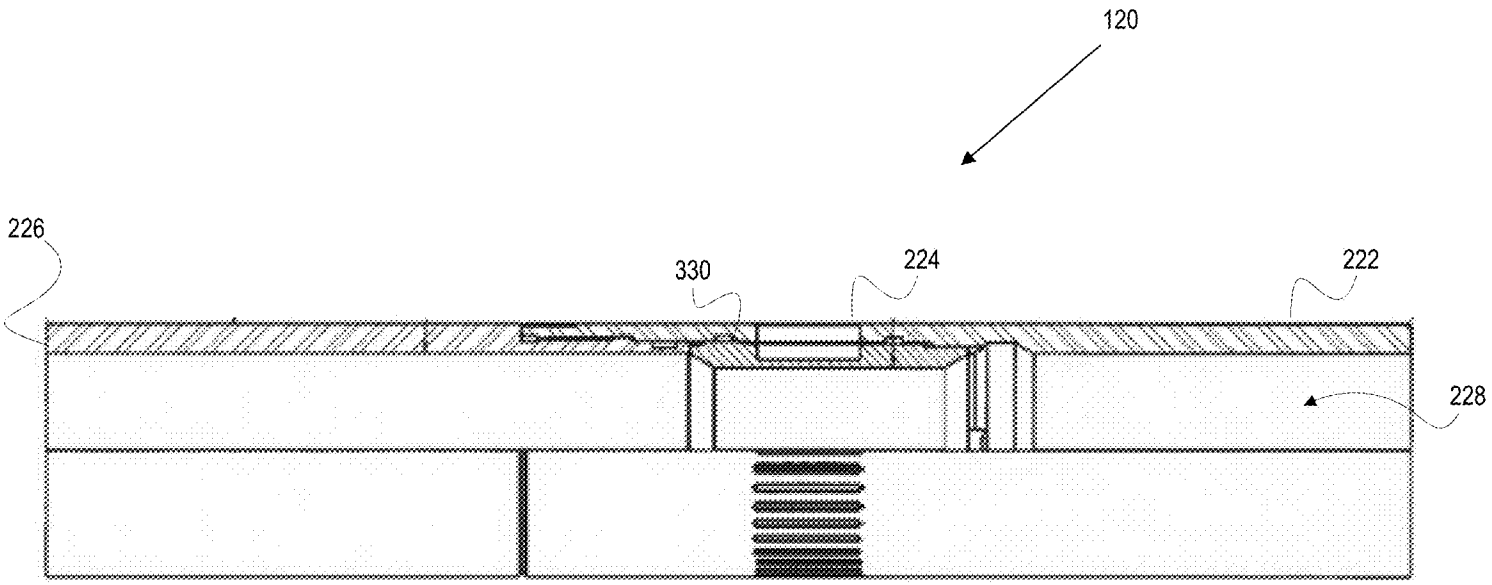
FIG. 3 is a partial cross-sectional view of an example of the well tool in FIG. 2 illustrating the removable collar preventing the flow path through the openings according to one aspect of the present disclosure.

FIG. 3 is a partial cross-sectional view of the well tool 120 in FIG. 2 with the collar 330 that can seal a flow path through the openings 224. In some examples, the openings 224 can be production fluid ports for allowing production fluid to pass from the subterranean formation 118 into the inner area 228 of the tubular body 222. The collar 330 can prevent fluid flow between the inner area 228 and the outer area during pre-completion operations. In additional or alternative examples, the well tool 120 can be coupled to a coiled tubing or tubing string extending into a wellbore 104 from a surface 106 of the wellbore 104 for allowing treatment fluid to flow through the inner area 228 during a hydraulic fracturing process. The outer wall 226 can include additional openings or fracturing fluid ports that allow the treatment fluid to flow from the inner area 228 of the tubular body 222 and create fractures 140 in the subterranean formation 118. The collar 330 can prevent the treatment fluid from passing through the productions fluid ports.

In this example, a first portion of the outer wall 226 that has the openings 224 has a first inner diameter that is greater than a second inner diameter of a second portion of the tubular body. The collar 330 has an outer diameter that is greater than the second inner diameter and less than the first inner diameter such that the collar 330 is physically retained, in regard to linear and rotational movement, to the tubular body 222 by being positioned in the first portion and trapped by the second portion. The collar 330 includes an indentation in an outer surface of the collar 330 that is aligned with the openings 224. In some examples, the indentation can form part of a radial flow path with the openings 224 in response to part of the collar 330 being removed.

Figure 4:
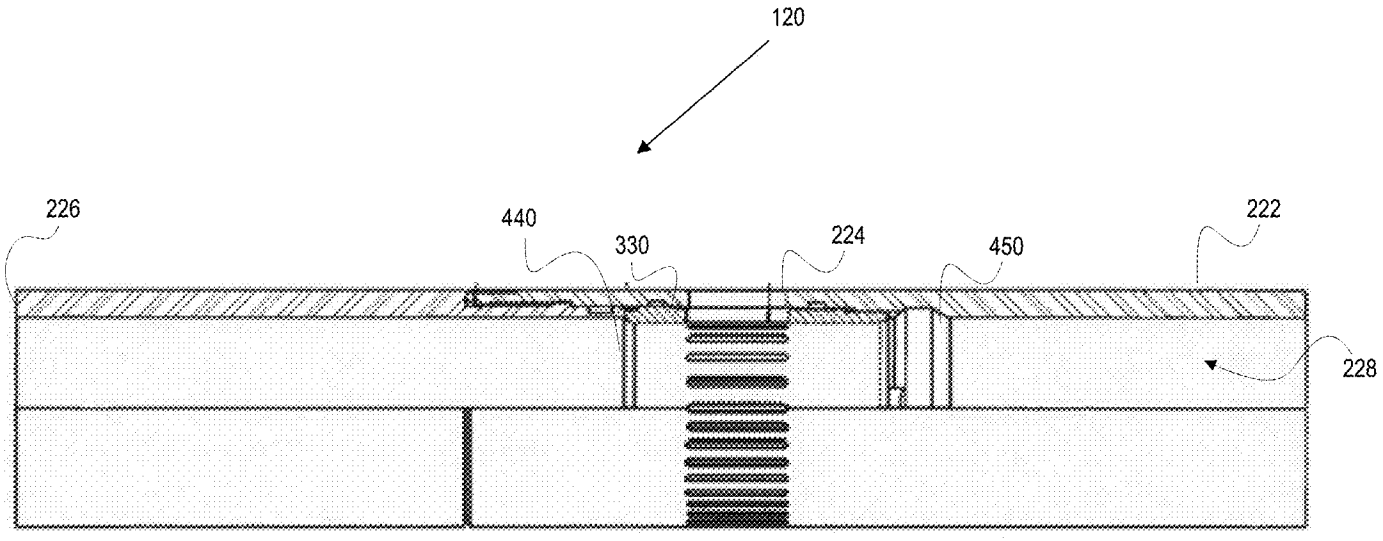
FIG. 4 is a partial cross-sectional view of an example of the well tool in FIG. 2 with a portion of the removable collar removed such that the flow path between an inner area and an outer area of the tubular body is formed according to one aspect of the present disclosure.

FIG. 4 is a partial cross-sectional view of the well tool in FIG. 2 with a portion of the collar 330 removed such that the flow path between an inner area 228 and an outer area of the tubular body 222 is formed. In this example, the indentation in the collar 330 forms a hole in through the side of the collar 330 in response to the portion of the collar being removed. In some aspects, the indentation can be a single groove along the outer surface of the collar 330 or a series of one or more indentations. In additional or alternative aspects, the groove or one or more indentations can have variable depths relative to the outer surface of the collar 330 such that removing a portion of the collar 330 forms flow paths through a portion of the openings 224. In some examples, as more of the collar 330 is removed, more of the indentations become flow paths between the inner area 228 and the openings 224. In additional or alternative examples, a portion of the collar can be removed such that an inner diameter of the collar is substantially equal to the inner diameter of the tubing body.

In some aspects, the collar 330 can be removed as part of a millout run. For example, after a hydraulic fracturing process, another tool (e.g., a milling tool) can pass through the inner area 228 of the tubular body 222 and remove any obstructions including the collar 330. In this example, one end of the collar 330 includes an inwardly sloped surface 440 for guiding the tool to a center of the collar 330. The other end of the collar 330 includes notches 450 for cooperating with members extending inwardly from an inner surface of the outer wall 226 to prevent the collar 330 from rotating as the tool passes through the center of the collar 330. The flow path formed through the openings 224 can allow production fluid to pass from the surrounding subterranean formation 118 into the inner area 228 of the tubular body 222.

In additional or alternative aspects, the collar 330 can be removed by being dissolved. In some examples, after a hydraulic fracturing process a dissolving fluid (e.g., an acid) can be injected through the inner area 228 of the tubular body 222 and dissolve a portion of the collar 330. In additional or alternative examples, the collar 330 can dissolve in response to contact with oil, water, or another fluid present in the wellbore 104 subsequent to the hydraulic fracturing process.

Figure 5:
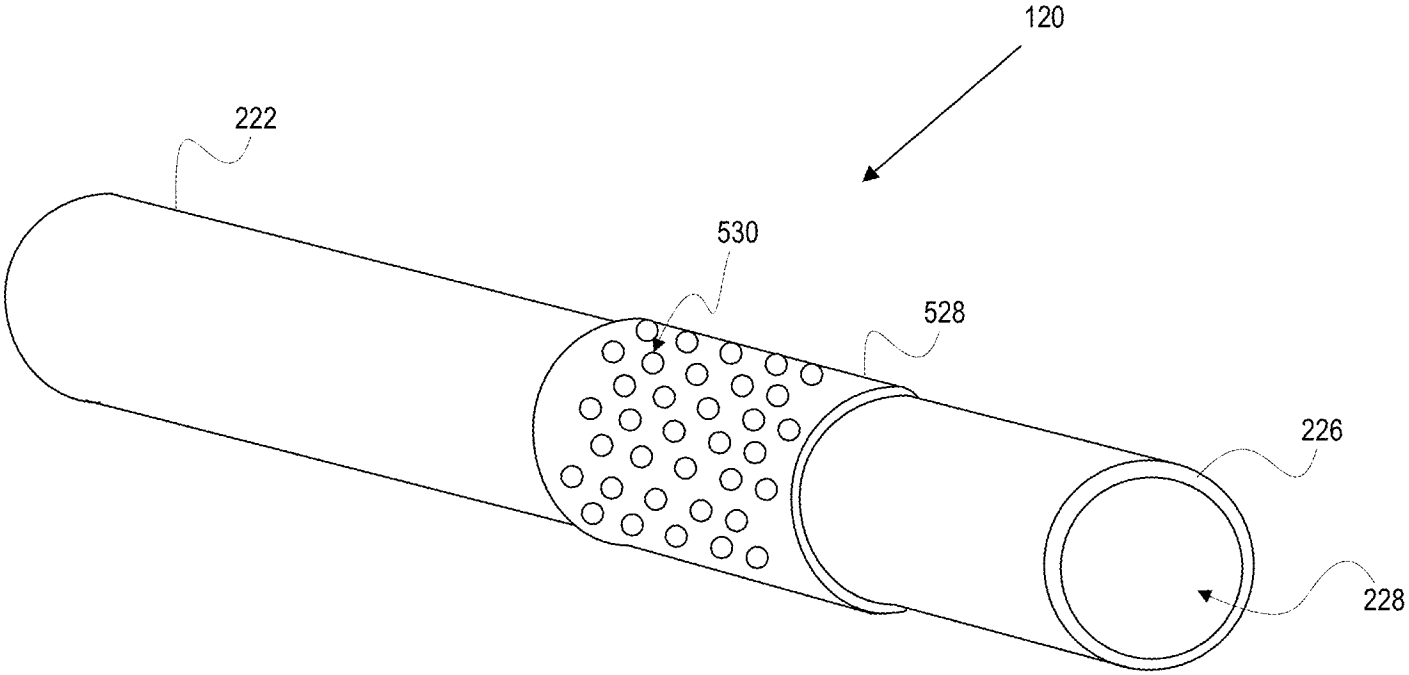
FIG. 5 is a perspective view of an example of a well tool having a screen for preventing flow of formation material and proppant material according to one aspect of the present disclosure.

FIG. 5 is a perspective view of the well tool 120 having a screen 528 for preventing flow of formation material and proppant material. The well tool 120 can include a screen 528 coupled to the tubular body 222 and positioned radially adjacent with one or more openings in the outer wall 226 of the tubular body 222. The screen 528 can prevent flow of formation material (e.g. rock) and proppant material from entering the openings (not visible) in the outer wall 226 of the tubular body 222 from an outer area of the tubular body 222. The screen 528 can include screen openings 530, which allow fluid flow between the outer area of tubular body 222 and the openings in the outer wall 226 of the tubular body 222.

Figure 6:
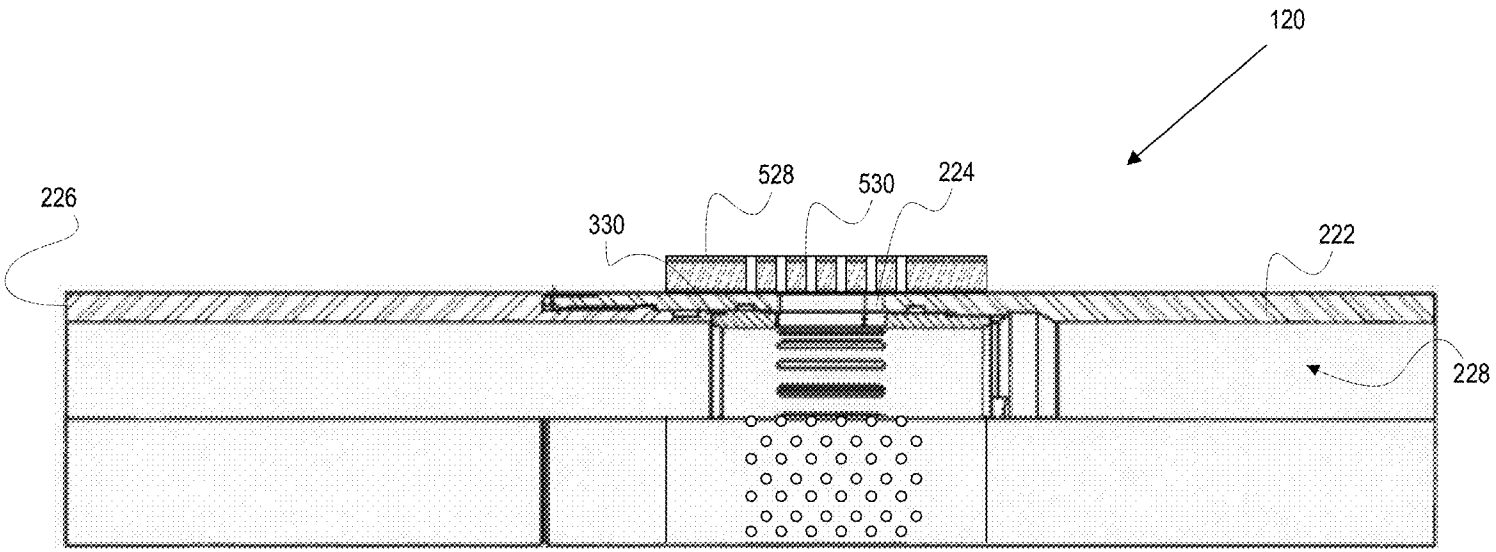
FIG. 6 is a partial cross-sectional view of an example of the well tool in FIG. 5 with a partially removed removable collar according to one aspect of the present disclosure.

FIG. 6 is a partial cross-sectional view of the well tool 120 with the milled out collar 330 having the screen 528 for preventing flow of formation material and proppant material. Formation fluid can flow from an outer area of the tubular body 222 through the screen 528 and through the openings 224 into the inner area of the tubular body 222. The screen openings 530 can be small enough to prevent flow of formation materials (e.g., rock) and proppant material between the outer area and the openings 224 through the screen openings 530.

Figure 7:
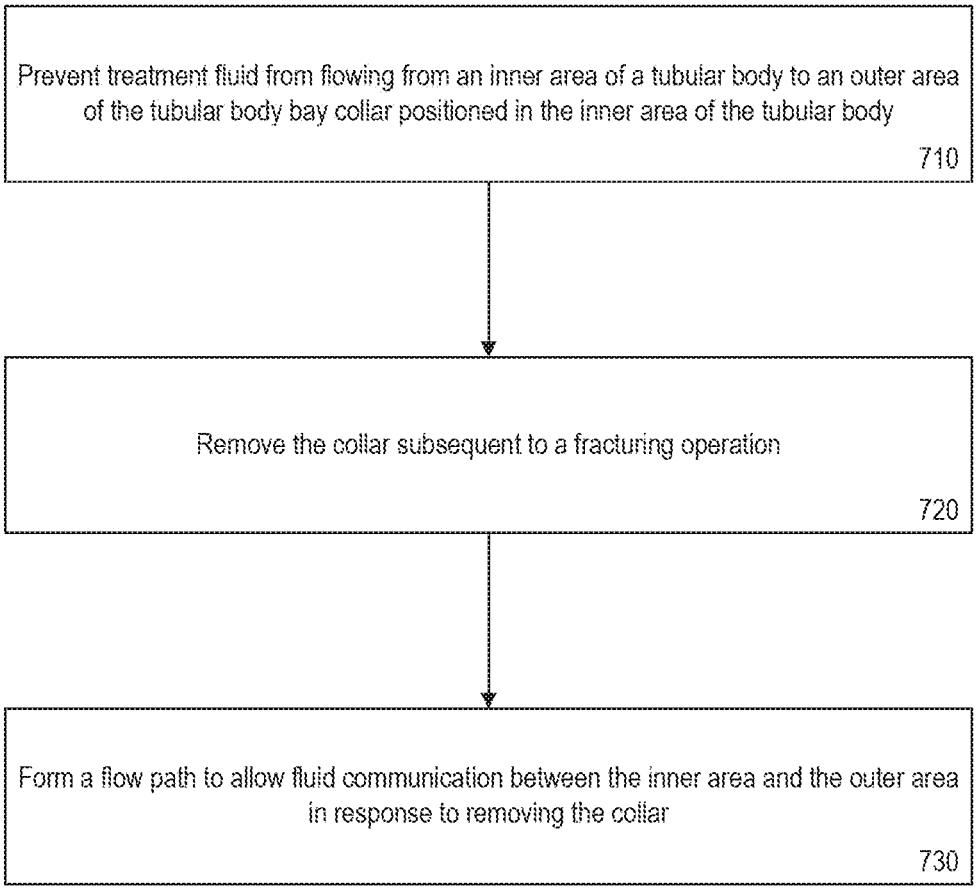
FIG. 7 is a flow chart of an example of a process for using a well tool having a removable collar for allowing production fluid flow according to one aspect of the present disclosure.

FIG. 7 is a flowchart of an example process for using a well tool with a removable collar for preventing radial fluid flow in a first state and allowing radial fluid flow in a second state. Using a well tool with a removable collar can allow for more robust and cheaper production fluid ports that do not add any additional operation to the completion. The removal of the collar and absence of moving parts can allow the cross-sectional area of the well tool to be more effectively used and can result in higher than normal pressure ratings. The process is described herein in reference to the well system 100, but other implementations are possible.

In block 710, a collar positioned in an inner area of a tubular body prevents treatment fluid from flowing from an inner area of the tubular body to an outer area of the tubular body. For example, the collar 330 is positioned in the inner area 228 of the tubular body 222 at a position radially adjacent to the openings 224 to prevent fluid flow between the inner area 228 and the outer area via the openings 224.

In block 720, the collar is removed subsequent to a hydraulic fracturing process. In some examples, a milling tool used to remove obstructions from the completion string 102 subsequent to a hydraulic fracturing operation can also remove a portion of the collar 330. In additional or alternative examples, the collar 330 can include an inwardly sloped surface for guiding the milling tool to a center of the collar 330. The collar 330 can further include one or more notches or members for cooperating with the inner surface of the outer wall 226 of the well tool 120 to prevent the collar 330 from rotating as the milling tool passes through the collar 330.

In additional or alternative examples, the collar 330 can include a dissolvable material or a material that dissolves faster than the well tool 120 in response to being exposed to a dissolving fluid. The dissolving fluid can be naturally present or injected into the wellbore 104 subsequent to the hydraulic fracturing process and the dissolving fluid can dissolve a portion of the collar 330.

In block 730, a flow path is formed to allow fluid flow between the inner area and the outer area of the tubular body in response to the collar being removed. In some examples, the collar 330 can be partially removed such that indentations in the collar 330 and the openings 224 form production fluid ports. The production fluid ports can define a production flow path for production fluid to flow from the subterranean formation 118 into the well tool 120 and to the surface 106. In some aspects, the flow path can be further defined by a screen 528 for preventing materials above a predetermined size from passing through the openings 224.

Although FIGS. 2-7 are described in regards to the well system 100 in FIG. 1, a well tool with a removable collar can be used in any well system for obstructing a radial flow path in a first state and forming part of a radial flow path in a second state. In some aspects, the collar can be a joint between an upper tubular body and a lower tubular body or a standalone component for obstructing a radial flow path in a first state and forming part of a radial flow path in a second state.

In some aspects, a well tool having a removable collar for allowing production fluid flow is provided according to one or more of the following examples:

EXAMPLE #1

A device that includes a collar having an outer wall defining an inner area for allowing fluid to flow through the collar. The collar can be positioned in a wellbore for preventing fluid flow between the inner area and an outer area of the collar during a hydraulic fracturing process. At least part of the collar is removable or dissolvable for forming an opening in the outer wall of the collar for a flow path to allow production fluid to flow between the inner area of the collar and the outer area of the collar subsequent to the hydraulic fracturing process.

EXAMPLE #2

The device of Example #1 can also include a tubular body that can be positioned in the wellbore. The tubular body includes an outer wall defining an inner area of the tubular body and includes an opening therethrough. The collar is positioned in the inner area of the tubular body for preventing fluid flow through the opening in the tubular body during the hydraulic fracturing process. The collar is at least partially removable for defining the flow path to allow production fluid to flow between the inner area of the collar and the outer area of the tubular body through the opening in the outer wall of the collar and the opening in the tubular body subsequent to the hydraulic fracturing process.

EXAMPLE #3

The device of Example #2 in which the opening in the tubular body is a first opening of a plurality of openings. The collar is positioned for preventing the fluid flow through the plurality of openings. The device further includes a screen that can be coupled to the tubular body and positioned in the flow path for preventing flow of formation material or proppant material between the inner area of the collar and the outer area of the tubular body through the plurality of openings.

EXAMPLE #4

The device of Example #2 in which the collar is at least partially removable by a milling tool movable along a longitudinal axis of the tubular body for removing obstructions from the tubular body subsequent to the hydraulic fracturing process. The tubular body is a completion string. The opening in the tubular body is a production fluid port. The flow path is a production flow path for allowing the production fluid to flow from a subterranean formation through which the wellbore is formed to a surface of the wellbore through the tubular body. The tubular body further includes a fracturing fluid port for forming a fracturing flow path for allowing treatment fluid to flow from the surface of the wellbore to the subterranean formation through the tubular body.

EXAMPLE #5

The device of Example #4 in which the collar is ring-shaped and includes a first end with an inwardly sloped surface for guiding the milling tool to a center of the collar and a second end with two or more notches for cooperating with members extending inwardly from the outer wall of the tubular body to prevent the collar from rotating about the longitudinal axis of the tubular body.

EXAMPLE #6

The device of Example #2 in which the tubular body includes a first portion of the outer wall that has the opening having a first inner diameter that is greater than a second inner diameter of a second portion of the tubular body. The collar has an outer diameter that is greater than the second inner diameter and less than the first inner diameter for being capable of coupling in the first portion such that an indentation in an outer surface of the collar is aligned with the opening. The collar is at least partially removable such that a third inner diameter of the collar is substantially equal to the second inner diameter of the tubing body and the indentation forms the opening in the outer wall of the collar.

EXAMPLE #7

The device of any of Examples #1-#6 further includes an upper tubular body and a lower tubular body. The upper tubular body can be longitudinally coupled to a first end of the collar for extending towards a surface of the wellbore. The lower tubular body can be longitudinally coupled to a second end of the collar for extending away from the surface of the wellbore. The collar includes a dissolvable material and the collar is at least partially removable by allowing the collar to contact a fluid present in the wellbore subsequent to the hydraulic fracturing process, the fluid for dissolving the dissolvable material.

EXAMPLE #8

A method includes preventing treatment fluid from flowing from an inner area of a tubular body to an outer area of the tubular body by a collar positioned in the inner area of the tubular body and covering an opening in an outer wall of the tubular body that defines the inner area. The tubular body is positioned in a wellbore for allowing treatment fluid to flow therethrough during a hydraulic fracturing process. The method also includes removing the collar subsequent to the hydraulic fracturing process. The method also includes forming a flow path to allow fluid flow between the inner area of the tubular body and the outer area of the tubular body through the opening in response to removing the collar.

EXAMPLE #9

The method of Example #8 in which forming the flow path comprises the opening becoming a production fluid port in response to removing the collar, the flow path being a production flow path for allowing fluid to flow from a subterranean formation through which the wellbore is formed to a surface of the wellbore through the tubular body, and the tubular body being a completion string. The method also includes allowing the treatment fluid to flow from the surface of the wellbore to the subterranean formation via the completion string and through a fracturing fluid port in the completion string.

EXAMPLE #10

The method of any of Examples #8-#9 in which preventing treatment fluid from flowing from the inner area of the tubular body to the outer area of the tubular body comprises: preventing treatment fluid from flowing from the inner area of the tubular body to the outer area of the tubular body by the collar being positioned to cover a plurality of openings including the opening; and preventing flow of formation material or proppant material between the inner area of the tubular body and the outer area of the tubular body through the plurality of openings by a screen coupled to an outer surface of the tubular body and positioned in the flow path.

EXAMPLE #11

The method of any of Examples #8-#10 in which removing the collar subsequent to the hydraulic fracturing process comprises moving a milling tool along a longitudinal axis of the tubular body subsequent to the hydraulic fracturing process.

EXAMPLE #12

The method of Example #11 in which moving the milling tool along the longitudinal axis of the tubular body further comprises: guiding the milling tool to a center of the collar, which has a ring shape, in response to the milling tool contacting a first end of the collar having an inwardly sloped surface; and preventing the milling tool from rotating the collar relative to the tubing body by the collar having a second end with two or more notches that cooperate with members extending inwardly from the outer wall of the tubing body.

EXAMPLE #13

The method of any of Examples #8-#10 in which removing the collar subsequent to the hydraulic fracturing process comprises dissolving the collar with a fluid present in the wellbore subsequent to the hydraulic fracturing process.

EXAMPLE #14

The method of any of Examples #8-#13 in which preventing the treatment fluid from flowing from the inner area of the tubular body to the outer area of the tubular body comprises the collar being positioned in a first portion of the outer wall that has the opening such that an indentation in an outer surface of the collar is aligned with the opening. The first portion has a first inner diameter that is greater than a second inner diameter of a second portion of the tubular body. The collar has an outer diameter that is greater than the second inner diameter and less than the first inner diameter. Removing the collar subsequent to the hydraulic fracturing process comprises removing part of the collar such that a third inner diameter of the collar is substantially equal to the second inner diameter of the tubing body and the indentation forms a hole through the collar.

EXAMPLE #15

A system includes a first tubular body, a second tubular body, and a collar. The first tubular body can be positioned in a wellbore. The first tubular body includes a first outer wall defining a first inner area and includes a first opening therethrough. The first opening for forming a first flow path to allow fluid flow between the first inner area and a first outer area of the first tubular body through the first opening during a hydraulic fracturing process and subsequent to the hydraulic fracturing process. The second tubular body can be positioned in the wellbore and longitudinally coupled to the first tubular body. The second tubular body includes a second outer wall defining a second inner area that is fluidly coupled to the first inner area and includes a second opening therethrough. The second opening can form a second flow path to allow fluid flow between the second inner area and a second outer area. The collar is positioned in the second inner area of the second tubular body for preventing fluid flow between the second inner area and the second outer area of the second tubular body through the second opening during the hydraulic fracturing process. The collar can be removed for forming a flow path to allow production fluid to flow between the second inner area of the second tubular body and the second outer area of the second tubular body through the second opening subsequent to the hydraulic fracturing process.

EXAMPLE #16

The system of Example #15 in which the first tubular body and the second tubular body are part of a completion string. The first opening is a fracturing fluid port for forming a fracturing flow path for allowing treatment fluid to flow from a surface of the wellbore to a subterranean formation through which the wellbore is formed. The first opening and the second opening are production fluid ports. The first flow path and the second flow path are production flow paths for allowing the production fluid to flow from the subterranean formation to a surface of the wellbore through the completion string.

EXAMPLE #17

The system of any of Examples #15-#16, in which the first opening is one opening of a plurality of first openings in the first tubular body. The second opening is one opening of a plurality of second openings in the second tubular body. The collar is positioned for preventing the fluid flow through the plurality of second openings. The system further includes a screen that can be coupled to the second tubular body and positioned in the second flow path for preventing flow of formation material or proppant material between the second inner area of the second tubular body and the second outer area of the second tubular body through the plurality of second openings.

EXAMPLE #18

The system of any of Examples #15-#17 can further include a milling tool movable along a longitudinal axis of the second tubular body for removing the collar from the second tubular body subsequent to the hydraulic fracturing process.

EXAMPLE #19

The system of any of Examples #15-#18 in which the collar has a ring shape and includes: a first end with an inwardly sloped surface for guiding the milling tool to a center of the collar; and a second end with two or more notches for cooperating with members extending inwardly from the second outer wall to prevent the collar from rotating about the longitudinal axis.

EXAMPLE #20

The system of any of Examples #15-#19 can further include a pump for injecting a fluid into the wellbore subsequent to the hydraulic fracturing process, the collar comprising a dissolvable material and the fluid for dissolving the dissolvable material.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A device comprising:

a collar having an outer wall defining an inner area for allowing fluid to flow through the collar, the collar being positionable in a wellbore for preventing fluid flow between the inner area and an outer area of the collar during a hydraulic fracturing process, at least part of the collar being removable or dissolvable for forming an opening in the outer wall of the collar for a flow path to allow production fluid to flow between the inner area of the collar and the outer area of the collar subsequent to the hydraulic fracturing process, wherein the collar is ring-shaped and comprises:

a first end with an inwardly sloped surface for guiding a milling tool that is usable to mill the collar to a center of the collar; and a second end with two or more notches for cooperating with members extending inwardly from the outer wall of a tubular body to prevent the collar from rotating about a longitudinal axis of the tubular body.

2. The device of claim 1, further comprising the tubular body positionable in the wellbore, the tubular body including an outer wall defining an inner area of the tubular body and including an opening therethrough, wherein the collar is positioned in the inner area of the tubular body for preventing fluid flow through the opening in the tubular body during the hydraulic fracturing process, wherein the collar is at least partially removable for defining the flow path to allow production fluid to flow between the inner area of the collar and the outer area of the tubular body through the opening in the outer wall of the collar and the opening in the tubular body subsequent to the hydraulic fracturing process.

3. The device of claim 2, wherein the opening in the tubular body is a first opening of a plurality of openings, wherein the collar is positioned for preventing the fluid flow through the plurality of openings, the device further comprising a screen coupleable to the tubular body and positionable in the flow path for preventing flow of formation material or proppant material between the inner area of the collar and the outer area of the tubular body through the plurality of openings.

4. The device of claim 2, wherein the collar is at least partially removable by the milling tool movable along the longitudinal axis of the tubular body for removing obstructions from the tubular body subsequent to the hydraulic fracturing process, wherein the tubular body is a completion string, the opening in the tubular body is a production fluid port, and the flow path is a production flow path for allowing the production fluid to flow from a subterranean formation through which the wellbore is formed to a surface of the wellbore through the tubular body, wherein the tubular body further includes a fracturing fluid port for forming a fracturing flow path for allowing treatment fluid to flow from the surface of the wellbore to the subterranean formation through the tubular body.

5. The device of claim 2, wherein the tubular body comprises a first portion of the outer wall that has the opening having a first inner diameter that is greater than a second inner diameter of a second portion of the tubular body, the collar having an outer diameter that is greater than the second inner diameter and less than the first inner diameter for being coupleable in the first portion such that an indentation in an outer surface of the collar is aligned with the opening, the collar being at least partially removable such that a third inner diameter of the collar is substantially equal to the second inner diameter of the tubing body and the indentation forms the opening in the outer wall of the collar.

6. The device of claim 1, further comprising:

an upper tubular body longitudinally coupleable to a first end of the collar for extending towards a surface of the wellbore; and a lower tubular body longitudinally coupleable to a second end of the collar for extending away from the surface of the wellbore, wherein the collar includes a dissolvable material and the collar is at least partially removable by allowing the collar to contact a fluid present in the wellbore subsequent to the hydraulic fracturing process, the fluid for dissolving the dissolvable material.

7. A method comprising:

preventing treatment fluid from flowing from an inner area of a tubular body to an outer area of the tubular body by a collar positioned in the inner area of the tubular body and covering an opening in an outer wall of the tubular body that defines the inner area, the tubular body being positioned in a wellbore for allowing treatment fluid to flow therethrough during a hydraulic fracturing process;

removing the collar subsequent to the hydraulic fracturing process by moving a milling tool along a longitudinal axis of the tubular body, wherein removing the collar further comprises:

guiding the milling tool to a center of the collar, which has a ring shape, in response to the milling tool contacting a first end of the collar having an inwardly sloped surface; and preventing the milling tool from rotating the collar relative to the tubing body by the collar having a second end with two or more notches that cooperate with members extending inwardly from the outer wall of the tubing body; and forming a flow path to allow fluid flow between the inner area of the tubular body and the outer area of the tubular body through the opening in response to removing the collar.

8. The method of claim 7, wherein forming the flow path comprises the opening becoming a production fluid port in response to removing the collar, the flow path being a production flow path for allowing fluid to flow from a subterranean formation through which the wellbore is formed to a surface of the wellbore through the tubular body, the tubular body being a completion string and the method further comprising allowing the treatment fluid to flow from the surface of the wellbore to the subterranean formation via the completion string and through a fracturing fluid port in the completion string.

9. The method of claim 7, wherein preventing treatment fluid from flowing from the inner area of the tubular body to the outer area of the tubular body comprises:

preventing treatment fluid from flowing from the inner area of the tubular body to the outer area of the tubular body by the collar being positioned to cover a plurality of openings including the opening; and preventing flow of formation material or proppant material between the inner area of the tubular body and the outer area of the tubular body through the plurality of openings by a screen coupled to an outer surface of the tubular body and positioned in the flow path.

10. The method of claim 7, wherein removing the collar subsequent to the hydraulic fracturing process comprises dissolving the collar with a fluid present in the wellbore subsequent to the hydraulic fracturing process.

11. The method of claim 7, wherein preventing the treatment fluid from flowing from the inner area of the tubular body to the outer area of the tubular body comprises the collar being positioned in a first portion of the outer wall that has the opening such that an indentation in an outer surface of the collar is aligned with the opening, the first portion having a first inner diameter that is greater than a second inner diameter of a second portion of the tubular body, the collar having an outer diameter that is greater than the second inner diameter and less than the first inner diameter, wherein removing the collar subsequent to the hydraulic fracturing process comprises removing part of the collar such that a third inner diameter of the collar is substantially equal to the second inner diameter of the tubing body and the indentation forms a hole through the collar.

12. A system comprising:

a first tubular body positionable in a wellbore, the first tubular body including a first outer wall defining a first inner area and including a first opening therethrough, the first opening for forming a first flow path to allow fluid flow between the first inner area and a first outer area of the first tubular body through the first opening during a hydraulic fracturing process and subsequent to the hydraulic fracturing process;

a second tubular body positionable in the wellbore and longitudinally coupled to the first tubular body, the second tubular body including a second outer wall defining a second inner area being fluidly coupled to the first inner area and including a second opening therethrough, the second opening for forming a second flow path to allow fluid flow between the second inner area and a second outer area; and a collar positioned in the second inner area of the second tubular body for preventing fluid flow between the second inner area and the second outer area of the second tubular body through the second opening during the hydraulic fracturing process, the collar being removable for forming a flow path to allow production fluid to flow between the second inner area of the second tubular body and the second outer area of the second tubular body through the second opening subsequent to the hydraulic fracturing process, wherein the collar is ring-shaped and comprises:

a first end with an inwardly sloped surface for guiding a milling tool to a center of the collar; and a second end with two or more notches for cooperating with members extending inwardly from the second outer wall to prevent the collar from rotating about a longitudinal axis of the second tubular body.

13. The system of claim 12, wherein the first tubular body and the second tubular body are part of a completion string, the first opening being a fracturing fluid port for forming a fracturing flow path for allowing treatment fluid to flow from a surface of the wellbore to a subterranean formation through which the wellbore is formed, the first opening and the second opening being production fluid ports, and the first flow path and the second flow path being production flow paths for allowing the production fluid to flow from the subterranean formation to a surface of the wellbore through the completion string.

14. The system of claim 12, wherein the first opening is one opening of a plurality of first openings in the first tubular body, wherein the second opening is one opening of a plurality of second openings in the second tubular body, wherein the collar is positioned for preventing the fluid flow through the plurality of second openings, the system further comprising a screen coupleable to the second tubular body and positionable in the second flow path for preventing flow of formation material or proppant material between the second inner area of the second tubular body and the second outer area of the second tubular body through the plurality of second openings.

15. The system of claim 12, wherein the milling tool is movable along the longitudinal axis of the second tubular body for removing the collar from the second tubular body subsequent to the hydraulic fracturing process.

16. The system of claim 12, further comprising a pump for injecting a fluid into the wellbore subsequent to the hydraulic fracturing process, the collar comprising a dissolvable material and the fluid for dissolving the dissolvable material.

* * * * *